US005947071A

United States Patent [19]

Alcamo

[11] Patent Number: 5,947,071

[45] Date of Patent: Sep. 7, 1999

[54] TOOL FREE QUICK CHANGE SPARK PLUG MECHANISM

[76] Inventor: John S. Alcamo, 68 Woodsedge Ave., Budd Lake, N.J. 07828

[21] Appl. No.: 09/035,399

[22] Filed: Mar. 5, 1998

Related U.S. Application Data

[63] Continuation-in-part of application No. 08/619,352, Mar. 21, 1996.

[51] Int. Cl.[6] ..... F02P 1/00

[52] U.S. Cl. ..... 123/169 EC; 285/38; 285/316

[58] Field of Search ..... 285/316, 38; 123/169 EC

[56] References Cited

U.S. PATENT DOCUMENTS

| | | | |
|---|---|---|---|
| 1,007,806 | 11/1911 | Smith . | |
| 1,131,154 | 3/1915 | Mosler . | |
| 2,081,571 | 5/1937 | Baade | 285/168 |
| 2,297,548 | 9/1942 | Fox | 285/169 |
| 3,747,583 | 7/1973 | Spengler et al. | 123/148 |
| 3,761,117 | 9/1973 | Shendure | 285/277 |
| 4,574,620 | 3/1986 | Cohl | 73/47 |

*Primary Examiner*—Dave W. Arola
*Attorney, Agent, or Firm*—Kenneth P. Glynn, Esq.

[57] ABSTRACT

The present invention is a tool free quick change spark plug mechanism. It includes a head insert, a spark plug and a locking housing. The head insert has a threaded base to be inserted into a spark plug port of an internal combustion engine. It is generally cylindrical and hollow, and has either a locking groove or an extended locking mechanism on its outside wall above the threaded base. The plug is generally cylindrical and elongated with an electrode for sparking and a terminal for a wire attachment, and has a seal with a greater diameter than the lower end of the plug for seating within the head insert. The locking housing is hollow and cylindrical to fit over the spark plug and head insert, and has on its inside wall, the other of the locking groove and extended locking mechanism. It also has an upper portion and a lower portion; these being telescopically interconnected and having a first, locked position wherein the upper portion engages the locking mechanism to secure the locking housing to the head insert, and a second, unlocked position.

10 Claims, 1 Drawing Sheet

TOOL FREE QUICK CHANGE SPARK PLUG MECHANISM

REFERENCE TO RELATED APPLICATION

This application is a Continuation-in-Part of currently pending U.S. patent application Ser. No. 08/619,352, filed on Mar. 21, 1996, and entitled "Tool Free Quick Change Spark Plug Mechanism" by the inventor herein.

BACKGROUND OF THE INVENTION

1. Field of the Invention

This invention relates to a tool free spark plug mechanism which permits quick spark plug changes. It will eliminate the need for any tools to remove and replace spark plugs on internal combustion engines for all types of applications including motor vehicles, marine vehicles, planes, tools, etc.

2. Information Disclosure Statement

The following is representative of prior art relating to various, spark plug designs:

U.S. Pat. No. 1,007,806 to Cecil H. Smith describes a spark plug comprising a body member adapted to be secured in a hydro-carbon engine, an insulating core positioned therein having a portion spaced peripherally from the body member, a conducting member engaged through the core and a spark terminal detachably engaged around the core and bearing against the body member. The terminal member comprises a portion of wire of proper material having a helix at one end adapted for circumscribing engagement with the core. In addition, a terminal extension is adapted to extend longitudinally of the plug and has an inwardly turned portion disposed in juxtaposition with the conducting member, the longitudinally extending portion having an outwardly bowed portion bearing against the body member.

U.S. Pat. No. 1,131,154 to Arthur R. Mosler illustrates a spark plug comprising a shell composed of inner, outer and intermediate sections, the inner section having holes through its inner ends and side walls, the intermediate section having an interior annular flange intermediate at its ends, a conducting wire and insulating block having reduced end portions and an enlarged intermediate portion, packing rings interposed between the enlarged intermediate portion of the block, the flange and the outer section of the shell, for holding the insulating block independently of the inner section, and another packing ring interposed between the flange and the outer end of the inner section of the shell.

U.S. Pat. No. 2,081,571 to Henry Baade shows a female member for a hose coupling having means to fix the member to a hose, a plurality of interior stepped surfaces, an annular groove formed between two adjacent stepped surfaces of the member, resilient packing material carried in the groove, an annular groove formed in the outer wall of the member, milled slots on opposite sides of the groove extending through the side walls of the member, and a locking link slidable in the groove. The locking link is provided with parallel side walls designed to project through the milled slots of form a section of reduced internal diameter of the member when the locking link is in one extreme position. The locking link also has expanded circular side walls designed to not reduce the internal diameter of the member when the locking link is moved to another extreme position. Resilient means are carried by the locking link to resiliently lock the link in either extreme position.

U.S. Pat. No. 2,297,548 to Alexander P. Fox describes a coupler having a cylinder for receiving a fitting having a groove. The coupler comprises independently biased and movable sleeves inside and outside respectively, opposite slots in the cylinder located in a plane normal to the axis of the cylinder, rollers having axes respectively in the planes of the slots and movable laterally and being oppositely and tangentially engageable at their central portions within said groove, spaced reduced portions on the ends of the rollers, and circular cam means carried within the outer independently movable sleeve. The circular cam means engage the spaced reduced portions of the rollers to force them inward when cleared by the inner sleeve, whereby the rollers rest centrally in the groove and are pressed at their ends to form the equivalents of centrally loaded oppositely reacting beams in their gripping actions upon the fitting.

U.S. Pat. No. 3,747,583 to Erich Spengler et al describes and arrangement for the quick insertion of an ignition plug which operates a motor vehicle having a combustion engine including cylinder heads and walls. The ignition plug comprises a sleeve having a thread formed thereon about its outer surface for cooperation with a correspondingly formed thread in a recess made in the cylinder wall, an inner profile formed on the sleeve,a first profile formed on the ignition plug cooperating with the inner profile of the sleeve and allowing insertion of the insertion with plug into the sleeve in the axial direction, the outer first profile on the ignition plug being constructed to cooperate with means formed on the sleeve to retain the ignition plug in the sleeve after a predetermined rotation of the ignition plug in the sleeve, a second outer profile formed on the ignition plug in the sleeve, a second outer profile formed on the ignition plug for the application of an appropriate tool thereto for the rotation of the ignition plug, means limiting the rotation of the ignition plug, in the sleeve whereby the application of a rotational movement by the tool will cause the rotation of the sleeve and to establish a threaded engagement between the sleeve and the thread formed in the recess.

U.S. Pat. No. 3,761,117 to Ashok S. Shendure illustrates a quick connect fitting of the type wherein a stem member is telescopically inserted into a body member with locking of the members accomplished by means of balls carried by the body member and adapted to be received in a groove of the stem member. The groove itself is defined by a flat annular bottom wall and diverging end walls. One end wall is defined by a generally frusto-conical surface. The other end wall is defined by a frusto-conical wall portion and a generally concave surface wall portion merging smoothly with the frusto-conical wall portion.

U.S. Pat. No. 4,574,620 to Arnold Cohl shows fixturing and processes for automotive diagnostic and repair procedures involving simultaneous pressurizing of the cylinders of a piston internal combustion engine for servicing the engine. The fixturing includes a manifold body having passages and a number of outlet ports pressurized by connection to a source of air pressure, each port being fitted with a pressure coupling for connection to one end of a pressure hose. Each pressure coupling includes a check valve which closes the associated outlet port if a pressure hose is not coupled thereto so that fewer hoses than the total number of outlet ports may be pressurized. Checks for leaking valves and piston rings are conducted by removal of one hose at a time after pressurization of all of the cylinders, while checks for head gasket leaks and valve servicing are conducted while a number of cylinders are simultaneously pressurized.

Notwithstanding the prior art, the present invention is neither taught nor rendered obvious thereby.

SUMMARY OF THE INVENTION

The present invention is a tool free quick change spark plug mechanism. It includes a head insert, a spark plug and a locking housing. The head insert has a threaded base adapted to be inserted into a spark plug port of an internal combustion engine, and generally has a hollow, cylindrical configuration with an outside wall and either a locking groove or an extended locking mechanism on its outside wall above the threaded base, as well as a ledge to seat a spark plug therein. The spark plug is generally cylindrical and elongated with a lower end with an electrode for sparking and an upper end with a terminal for a wire attachment. The spark plug has a seal with a greater diameter than the lower end of the spark plug for unsecure seating within the head insert. The locking housing has a hollow cylindrical configuration adapted to fit over the spark plug and head insert, and has on its inside wall, the other of the locking groove and extended locking mechanism. It also has an upper portion and a lower portion, with its upper portion and lower portion being telescopically interconnected and having a first, locked position wherein the upper portion engages the locking mechanism to secure the locking housing to the head insert and to thereby secure the seating of the spark plug and seal it to maintain engine compression during use. There is also a second, unlocked position wherein the locking mechanism is disengaged to permit removal of the locking housing and the spark plug from the head insert. When assembled, the locking housing of the mechanism of the present invention is biased in the first, locking position, e.g. by use of a spring. In preferred embodiments, the upper portion of the locking housing and the lower portion of the locking housing each have an upwardly extending handle to facilitate movement of the upper portion relative to the lower portion so as to permit movement from the first, locked position to the second, unlocked position.

BRIEF DESCRIPTION OF THE DRAWINGS

The present invention should be more fully understood when the specification herein is taken in conjunction with the drawings appended hereto wherein.

DETAILED DESCRIPTION OF THE PRESENT INVENTION

The present invention mechanism is a device to enable easy changing of spark plugs used in conjunction with internal combustion engines. It basically involves the use of three critical components. These components include a head insert for screwing into a conventional spark plug port of an engine in place of a conventional spark plug itself, a unique spark plug which simply drops into the head insert and a locking housing which performs a number of functions. When the spark plug component is dropped into the head insert, the locking housing fits over the plug and securely nests the plug with the head insert, creating at least one compression seal. The locking housing securely but removably attaches to the head insert and by movement of an element of the locking housing, the locking housing itself is easily removed and the spark plug is simply taken out by hand when the locking mechanism is removed without the need for unscrewing or "breaking" a tightly screwed plug.

The components described in conjunction with the present invention are set forth herein as generally cylindrical. However, it should be understood that the term "generally cylindrical" should be construed broadly to mean components which would fit into a generally cylindrical space. Thus, one would not exceed the scope of the present invention by making octagonal or hexagonal components provided that they were capable of fitting into areas of internal combustion engines generally preserved for cylindrical spark plugs. Also, the locking grooves and extended locking means or locking mechanisms described herein may be replaced by equivalently functioning mechanism without exceeding the scope of the present invention. Finally, the invention herein is described in a manner wherein the locking housing fits over the head insert. However, in the alternative, the head insert could be of larger diameter and the locking mechanism be of lesser diameter so as to nest into the head insert rather than over it.

Figure 1:
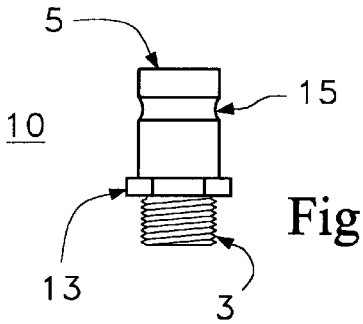
FIG. 1 shows a front view of a present invention head insert which is initially installed into an engine cylinder as a component of the head tool free quick change spark plug mechanism in accordance with the present invention mechanism.
Figure 2:
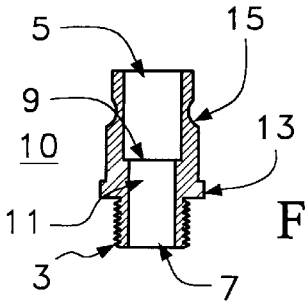
FIG. 2 shows a cross section of the head insert shown in FIG. 1.

Referring to FIGS. 1 and 2, there are shown an front view and a front cut view of the present invention head insert 10 which includes threading 3, open top 5 and bottom 7 with a generally cylindrical configuration, as shown. There is a nut segment 13 which may be configured to fit spark plug wrenches or otherwise sized.

As shown in FIG. 2, the inside of head insert 10 has a large diameter upper portion 5 and a smaller diameter lower portion 7. This creates a ledge 9 on which a spark plug such as plug 20 may seat, discussed below. As shown in both FIGS. 1 and 2, there is a locking groove 15 on its outside for receiving an extended locking mechanism contained within the locking housing discussed below.

Figure 3:
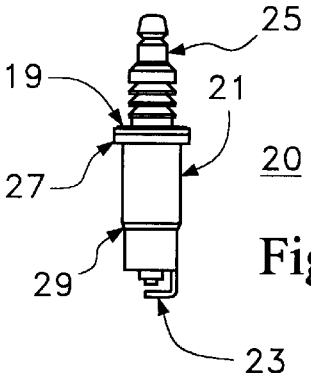
FIG. 3 illustrates a front view of a present invention replaceable spark plug and seal assembly used in the tool free quick change spark plug mechanism of the present invention.

Referring now to FIG. 3, there is shown a front view of present invention spark plug 20. It is elongated and generally cylindrical and has an electrode 23 at its bottom for sparking and a wire connector or terminal 25 at its top for electrical connection. It has a main body 21 with a ring or seal 27 which has a diameter greater than the remainder of plug 20. Seal 27 includes a spring 19 to enhance compressing sealing when assembled as a component of the present invention mechanism. There is also a second lower seal 29 which has a greater diameter than the lower end of plug 20 located below it, as well as a lesser diameter than (upper) seal 27. (In other embodiments, a single seal may be used, but a dual seal, as described in this embodiment, is preferred.) After head insert 10 of FIG. 2 is screwed into a spark plug port of an internal combustion engine, plug 20 is dropped into head insert 10 wherein seal 27 rests atop head insert 10 and seal 29 rests on ledge 9 (as shown in FIG. 2). Thereafter, locking housing 30 shown in FIG. 4 is fitted over both plug 20 and head insert 10 and locks into a compressed, locked, sealed position.

Figure 4:
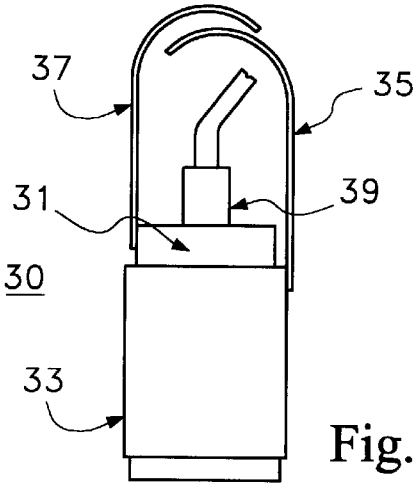
FIG. 4 shows a front view of a present invention quick release mechanism used to secure and release the spark plug from the head insert and other components used in the tool free quick change spark plug mechanism of the present invention.
Figure 5:
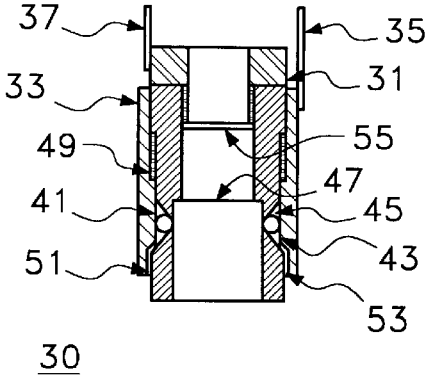
FIG. 5 shows a cross section of the tool free quick change spark plug mechanism shown in FIG. 4; and, FIG. 6 shows a front view of an alternative embodiment tool free quick change spark plug mechanism of the present invention.

Referring now to FIGS. 4 and 5, there is shown a locking housing 30 which includes both an upper portion 31 and a lower portion 33. Handle 35 is connected to lower portion 33 and extends upwardly and inwardly, as shown. Likewise, handle 37 is attached to upper portion 31 and extends upwardly and inwardly and above handle 35 with a sufficient gap to permit proper functioning of locking housing 30 by handle 35 and handle 37 being pulled together. Terminal wire 39 is also shown for connection to spark plug 20.

Upper portion 31 and lower portion 33 are telescopically interconnected and, as shown in FIG. 5, upper portion 31 has cut areas such as area 45 which contains extended locking means, in this case, ball bearings 41 and 43. Spring 49 biases lower portion 33 downwardly relative to upper portion 31 so that lower portion 33 pushes ball bearings 41 and 43 inwardly by virtue of the thick wall of lower portion 33. This downward bias maintains ball bearings 41 and 43 in a locked position, as illustrated in FIG. 5. Thus, when locking housing 30 is slipped over head insert 10, ball bearings 41 and 43 slip into groove 15 shown in FIG. 1 to maintain the locking position. However, when handles 37 and 35 are squeezed together, lower portion 33 rises up and chambers 51 and 53 rise up to ball bearings 41 and 43 to release the pressure on them to freely release locking housing 30 from head insert 10 to permit easy removal and removal of the plug 20 (FIG. 3). Note that locking housing 30 is centrally hollow and has a larger lower diameter and a smaller upper diameter so that ledge 47 will rest on the top of compression spring 19, seal 27 and head insert 10, and terminal 25 will extend past ledge 55 for attachment to wire 39. As can now be seen, after installation when it is time to change a plug, a user could merely pull up handle 35 toward handle 37 to release the pressure on ball bearings 41 and 43, easily remove locking housing 30 and lift out plug 20 in a single movement. A new plug would replace old plug 20 and locking housing 30 would be snapped back on to reseal the mechanism, without the need of any tools.

Figure 6:
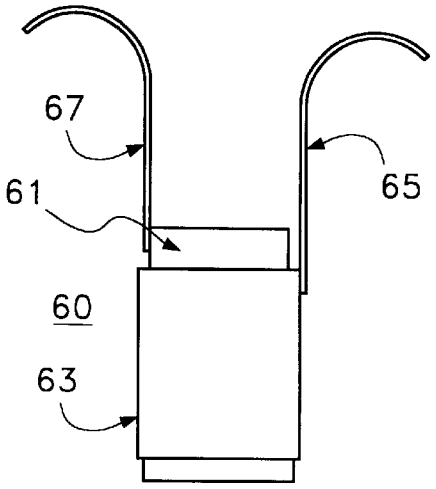

FIG. 6 shows a front view of alternative embodiment locking housing 60, having upper portion 61 and lower portion 63. In this case, the handles 65 and 67 extend upwardly and outwardly away from one another so that two hands may be used. For example, a user would hold handle 67 in place with the pointer finger and thumb of the left hand and pull handle 65 up with the pointer finger of the right hand for release. While handles are shown, they are not essential. For example, in FIG. 6, lower portion 63 could be serrated for easy gripping and the user could push down on upper portion 61 and pull up on lower portion 63 for quick, tool free release. In preferred embodiments, the extended locking means may additionally lock on to the spark plug during the removal process so that both the spark plug and the locking housing are removed simultaneously.

Obviously, numerous modifications and variations of the present invention are possible in light of the above teachings. It is therefore understood that within the scope of the appended claims, the invention may be practiced otherwise than as specifically described herein.

What is claimed is:

1. A tool free quick change spark plug mechanism, which comprises:

(a) a head insert, said head insert having a threaded base adapted to be inserted into a spark plug port of an internal combustion engine, said head insert having a hollow, cylindrical configuration with an outside wall and having one of a locking groove and an extended locking means located on said outside wall above said threaded base, and having means to seat a spark plug therein;

(b) a spark plug, being generally cylindrical and elongated, and having a lower end with an electrode for sparking and an upper end with a terminal for a wire attachment, said spark plug having a seal with a greater diameter than the lower end of said spark plug, said spark plug being unsecurely seated within said head insert, said spark plug having means for biasing said seal against said spark plug seating means on said head insert; and, (c) a locking housing having a hollow cylindrical configuration to fit over said spark plug and said head insert, and having on an inside wall a shoulder for engagement with said means for biasing and the other of said locking groove and extended locking means, said locking housing comprising an upper portion and a lower portion, said upper portion and lower portion being telescopically interconnected and having means for biasing said locking housing in a first, locked position wherein said upper portion engages said locking means to secure said locking housing to said head insert, said upper portion having a second, unlocked position wherein said locking means is manually disengaged from said first, locked position to permit removal of said locking housing and said spark plug from said head insert; and, (d) said upper portion of said locking housing and said lower portion of said locking housing each have an upwardly extending handle to facilitate movement of said upper portion relative to said lower portion relative to one another so as to permit movement from said first, locked position to said second, unlocked position.

2. The tool free quick change spark plug mechanism of claim 1 wherein said handles for each of said upper portion and said lower portion extend upwardly and then inwardly.

3. The tool free quick change spark plug mechanism of claim 1 wherein said handles extend upwardly and inwardly and overlap one another with sufficient space therebetween to permit movement of said locking housing from its first, locking position to its second, unlocked position.

4. The tool free quick change spark plug mechanism of claim 1 wherein said handles extend upwardly and then outwardly away from one another.

5. The tool free quick change spark plug mechanism of claim 1 wherein said spark plug seal is a, lower seal with a greater diameter than the lower end of said spark plug and said spark plug includes an upper seal with a greater diameter than said lower seal, and with a greater diameter than the remainder of said spark plug and said upper seal seats by resting atop said head insert, and said locking housing has an internal open area fitting over said spark plug and engaging and compressing said spark plug against said head insert when said mechanism is in its first locked position.

6. A tool free quick change spark plug mechanism, which comprises:

(a) a head insert, said head insert having a threaded base adapted to be inserted into a spark plug port of an internal combustion engine, said head insert having a hollow, cylindrical configuration with an outside wall and having one of a locking groove and an extended locking means located on said outside wall above said threaded base, and having means to seat a spark plug therein;

(b) a spark plug, being generally cylindrical and elongated, and having a lower end with an electrode for sparking and an upper end with a terminal for a wire attachment, said spark plug having a seal with a greater diameter than the lower end of said spark plug, said spark plug being unsecurely seated within said head insert, said spark plug having means for biasing said seal against said spark plug seating means on said head insert; and, (c) a locking housing having a hollow cylindrical configuration to fit over said spark plug and said head insert, and having on an inside wall the other of said locking groove and extended locking means, said locking housing comprising an upper portion and a lower portion, said upper portion and lower portion being telescopically interconnected and having means for biasing said locking housing in a first, locked position wherein said upper portion engages said locking means to secure said locking housing to said head insert, said upper portion having a second, unlocked position wherein said locking means is manually disengaged from said first, locked position to permit removal of said locking housing and said spark plug from said head insert; and, (d) said locking housing has an internal open area to fit over said spark plug and engage said means for biasing said spark plug thereby compressing said spark plug against said head insert when said mechanism is in its first locked position.

7. The tool free quick change spark plug mechanism of claim 6 wherein said means for biasing said spark plug includes a seal spring which compresses said spark plug seal on said head insert when said mechanism is assembled in its first, locked position so as to further maintain compression when said mechanism is inserted into a spark plug port of an internal combustion engine and said internal combustion engine is running.

8. The tool free quick change spark plug mechanism of claim 6 wherein said head insert contains said locking groove and said locking housing contains said extending locking means.

9. A tool free quick change spark plug mechanism, which comprises:

(a) a head insert, said head insert having a threaded base adapted to be inserted into a spark plug port of an internal combustion engine, said head insert having a hollow, cylindrical configuration with an outside wall and having one of a locking groove and an extended locking means located on said outside wall above said threaded base, and having means to seat a spark plug therein;

(b) a spark plug, being generally cylindrical and elongated, and having a lower end with an electrode for sparking and an upper end with a terminal for a wire attachment, said spark plug having a seal with a greater diameter than the lower end of said spark plug, said spark plug being unsecurely seated within said head insert, said spark plug having means for biasing said seal against said spark plug seating means on said head insert; and, (c) a locking housing having a hollow cylindrical configuration to fit over said spark plug and said head insert, and having on an inside wall a shoulder for engagement with said means for blasing and the other of said locking groove and extended locking means, said locking housing comprising an upper portion and a lower portion, said upper portion and lower portion being telescopically interconnected and having means for biasing said locking housing in a first, locked position wherein said upper portion engages said locking means to secure said locking housing to said head insert, said upper portion, having a second, unlocked position wherein said locking means is manually disengaged from said first, locked position to permit removal of said locking housing and said spark plug from said head insert; and, (d) said means to seat a spark plug is a ledge formed within said head insert.

10. The tool free quick change spark plug mechanism of claim 9 wherein said ledge is established by having an upper bore in said head insert having a diameter greater than said seal of said spark plug and having a lower bore in said head insert having a diameter less than the diameter of said seal of said spark plug.

* * * * *